US011946335B2

(12) United States Patent
Sims et al.

(10) Patent No.: US 11,946,335 B2
(45) Date of Patent: Apr. 2, 2024

(54) WET SHOE SYSTEM

(71) Applicant: INNOVEX DOWNHOLE SOLUTIONS, INC., Houston, TX (US)

(72) Inventors: Bryan Sims, Houston, TX (US); Rodney Hardin, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 17/580,171

(22) Filed: Jan. 20, 2022

(65) Prior Publication Data

US 2022/0228461 A1 Jul. 21, 2022

Related U.S. Application Data

(60) Provisional application No. 63/139,999, filed on Jan. 21, 2021.

(51) Int. Cl.
*E21B 33/16* (2006.01)
*E21B 34/06* (2006.01)

(52) U.S. Cl.
CPC ..... *E21B 33/16* (2013.01); *E21B 34/06* (2013.01); *E21B 2200/05* (2020.05)

(58) Field of Classification Search
CPC ..... E21B 34/06; E21B 33/16; E21B 34/063; E21B 2200/05; E21B 2200/08; E21B 17/14
See application file for complete search history.

(56) References Cited

U.S. PATENT DOCUMENTS

| | | | | |
|---|---|---|---|---|
| 7,234,522 | B2 * | 6/2007 | Johnson | E21B 7/20 166/291 |
| 9,303,482 | B2 * | 4/2016 | Hall | E21B 33/165 |
| 9,835,008 | B2 * | 12/2017 | Rogers | E21B 34/00 |
| 10,378,304 | B2 * | 8/2019 | Budde | E21B 34/10 |
| 2011/0290344 | A1 * | 12/2011 | Groesbeck | E21B 34/16 137/430 |
| 2015/0101801 | A1 * | 4/2015 | Budde | E21B 33/14 166/387 |
| 2022/0154553 | A1 * | 5/2022 | Giroux | E21B 21/10 |
| 2023/0059642 | A1 * | 2/2023 | Al-Mousa | E21B 34/063 |

* cited by examiner

*Primary Examiner* — Yong-Suk (Philip) Ro
(74) *Attorney, Agent, or Firm* — MH2 TECHNOLOGY LAW GROUP, LLP

(57) ABSTRACT

A downhole assembly includes a float tool configured to be connected to a casing string and including one or more one-way valves configured to permit fluid flow in a downhole direction and to prevent fluid flow in an uphole direction, and a first wiper plug configured to be deployed into a well via the casing string and engage the float tool. The first wiper plug comprises a valve element that is configured to prevent fluid flow through the first wiper plug at least in the uphole direction.

19 Claims, 5 Drawing Sheets

WET SHOE SYSTEM

CROSS-REFERENCE TO RELATED APPLICATIONS

This application claims priority to U.S. Provisional Patent Application Ser. No. 63/139,999, which was filed on Jan. 21, 2021 and is incorporated herein by reference in its entirety.

BACKGROUND

Casing is typically run into a well to complete the well. The casing is cemented in place by pumping a cement slurry through the casing and back up into an annulus formed between the well and the casing. The cement then sets in the annulus and subsequent well treatment processes may commence.

The cementing process presents several challenges. One such challenge is displacing the cement through the casing, and then preventing the cement from flowing back or "U-tubing" into the casing from the annulus. Float tools are widely used to address this challenge. Additionally, float tools permit the casing string to be partially supported in the well by buoyancy, rather than fully supported by the pipe handling equipment of the drilling rig, as the casing string is run into the well.

Float tools generally include a float collar and a float shoe, both of which may include one-way valves to prevent u-tubing. The float collar is connected to the casing string above the float shoe, and the float shoe connected to the end of the casing string. Generally, one or more lengths of casing separate the float collar from the float shoe. A "shoe track" is defined between the float collar and the float shoe. Cement may reside in the shoe track even after the cement job is complete. This shoe track may thus represent unused or generally blocked sections of the well. Thus, advances have been made toward a "wet" shoe, which eliminates at least some of this shoe track. In a wet shoe system, the float collar is close-coupled to the float shoe, and the wiper plugs generally land directly on the float collar and latch therein, displacing most or all of the cement out of the casing string through the float shoe.

In wet shoe systems, after the system is fully run and pressured, only the valves in the float collar and float shoe prevent the backflow of cement. These valves, however, experience flow through of the cement as it is displaced into the annulus. Erosion of the valves may thus be a concern, as it may cause the valves to leak. If the valves leak, cement may move into the float shoe and render the float shoe inoperative. This may result in lost time and expense spent on remediation efforts, such as drilling through the float shoe.

SUMMARY

Embodiments of the disclosure provide a downhole assembly including a float tool configured to be connected to a casing string and including one or more one-way valves configured to permit fluid flow in a downhole direction and to prevent fluid flow in an uphole direction, and a first wiper plug configured to be deployed into a well via the casing string and engage the float tool. The first wiper plug comprises a valve element that is configured to prevent fluid flow through the first wiper plug at least in the uphole direction.

Embodiments of the disclosure also include a method for cementing a well including deploying a float tool having one or more one-way valves into a well as part of a casing string, pumping cement into the casing string in the well, deploying a first wiper plug through the casing string down to the float tool so as to displace at least some of the cement from the casing string into an annulus between the casing string and the well, preventing the cement from flowing in an uphole direction through the first wiper plug using a valve element positioned in the first wiper plug, and pumping fluid through the first wiper plug in a downhole direction after deploying the first wiper plug down to the float tool.

Embodiments of the disclosure further include a downhole assembly including a float shoe having two or more one-way valves, a float collar coupled to the float shoe and having one or more one-way valves, a first wiper plug that is configured to land on the float collar, the first wiper plug including a valve element configured to prevent fluid flow through the first wiper plug at least in an uphole direction, and a second wiper plug that is configured to land on the first wiper plug, the second wiper plug including a rupture disk configured to block fluid flow through the second wiper plug. Upon rupturing the rupture disk, the second wiper plug permits fluid flow therethrough at least in a downhole direction.

BRIEF DESCRIPTION OF THE DRAWINGS

The present disclosure may best be understood by referring to the following description and accompanying drawings that are used to illustrate some embodiments. In the drawings.

DETAILED DESCRIPTION

Figure 1:
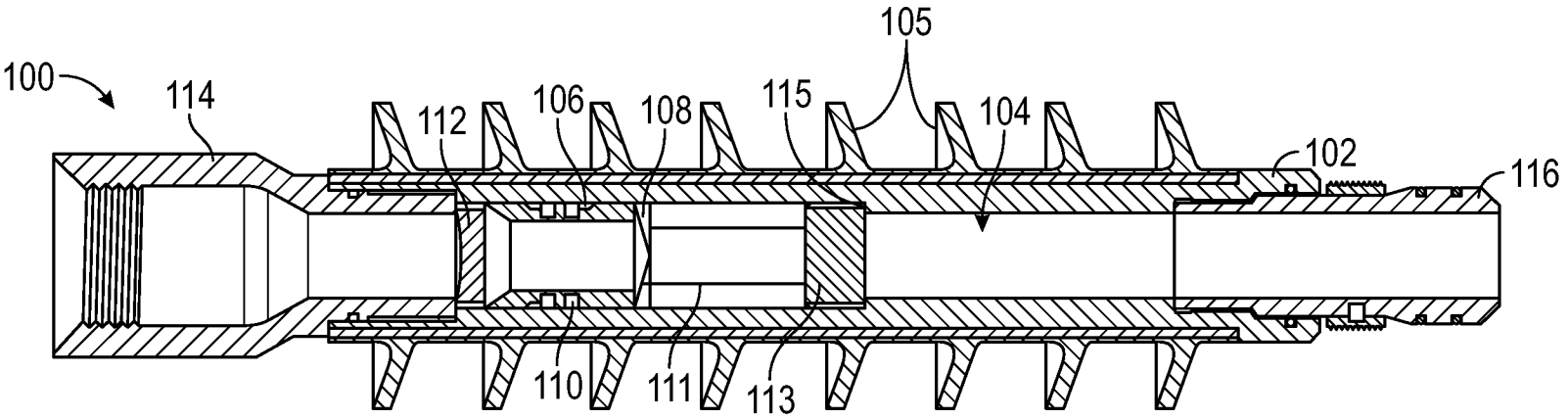
FIG. 1 illustrates a side, cross-sectional view of a wiper plug having a valve element in a closed position, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be intepreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

Figure 2:
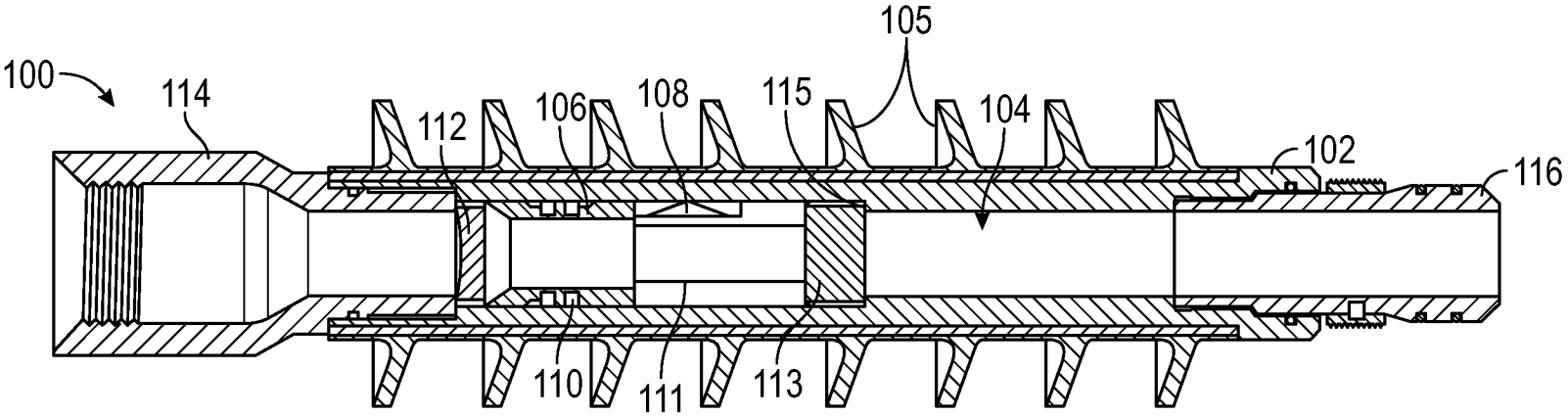
FIG. 2 illustrates another side, cross-sectional view of the wiper plug having the valve element in an open position, according to an embodiment.

FIGS. 1 and 2 illustrate side, cross-sectional views of a wiper plug 100, according to an embodiment. The wiper plug 100 may be configured to be deployed into a well as part of a downhole float tool assembly for cementing a casing string into the well, as will be described, by way of example, in greater detail below. The illustrative wiper plug 100 includes a main body 102 through which an axially-extending bore 104 is defined. Fins or wipers 105 may extend from the main body 102, and may be configured to press (e.g., deflect) against a surrounding tubular, such as the interior of the casing string, in order to at least partially seal therewith and press cement downwards as the wiper plug 100 is forced to move in a downhole direction through the casing string.

A valve element 106 may be positioned in the bore 104. The valve element 106 may be configured to permit fluid flow through the bore 104 in a first direction, generally downhole toward the distal end of the well. The valve element 106 may also be configured to prevent fluid flow through the bore 104 in a second direction that is opposite to the first direction, e.g., generally uphole toward the surface. In at least some embodiments, the valve element 106 may be secured within the bore 104 and may not be deployed separately from the main body 102.

In an embodiment, the valve element 106 may be a flapper valve. Accordingly, the valve element 106 may include a flapper 108 and a base 110. In at least some embodiments, the base 110 may be generally cylindrical and its outer surface may seal with the bore 104, e.g., in an enlarged portion of the bore 104, as shown. Further, the flapper 108 may be pivotally secured to the base 110, e.g., via a hinge. In at least some embodiments, the flapper 108 may be biased toward the base 110, e.g., using a torsion spring in the hinge. Thus, the flapper 108 may be biased toward a closed position, in which the flapper 108 extends across and blocks the bore 104, e.g., by sealing with the base 110. FIG. 1 specifically shows the flapper 108 in the closed position. Fluid flow in the first direction may overcome any biasing forces applied to the flapper 108 and pivotally displace the flapper 108 away from the base 110, thereby moving the flapper 108 to an open position. As such, fluid flow in the first direction may be permitted past the flapper 108 in the first direction while the flapper 108 is in the open position. FIG. 2 specifically shows the flapper 108 in a fully-open position; however, it will be appreciated that any position in which the flapper 108 permits fluid flow may be considered an open position.

In the illustrated embodiment, the valve element 106 also includes a spacer 111 and an end ring 113. The spacer 111 may be coupled to and extend from the base 110, and the end ring 113 may be coupled to the spacer 111. The end ring 113 may be positioned in engagement with a shoulder 115 of the main body 102, so as to locate the valve element 106 on one axial side in the bore 104. The combination of the spacer 111 and the end ring 113 may provide sufficient space for the flapper 108 to pivot, unobstructed by engagement with other structures.

The valve element 106 is not limited to a flapper valve, however. In various embodiments, the valve element 106 may be any other type of valve. For example, the valve element 106 may be a ball-drop or caged-ball valve. In other examples, the valve element 106 may be a plunger valve, poppet valve, dart valve, an actuatable gate valve, a sleeve-actuated valve, or any other type of valve.

A rupture disk 112 may also be positioned in the bore 104. For example, the rupture disk 112 may be adjacent to and engaged on an axial side by the base 110. An upper connector 114 may also be at least partially received into the bore 104 and secured therein, e.g., by a threaded engagement. The upper connector 114 may engage an opposite axial side of the rupture disk 112, such that the rupture disk 112 is entrained within the bore 104 by the upper connector 114 and the base 110. As such, the valve element 106 is also entrained in the bore 104 between the upper connector 114 and the shoulder 115. The upper connector 114 may include an open, threaded end, which may be configured to connect to a superposed plug, as will be described by way of example below, or another structure.

The wiper plug 100 may also include a lower latching member 116. The lower latching member 116 may be secured at least partially in the bore 104, e.g., threaded therein. Further, the lower latching member 116 may extend axially from the main body 102 and may provide one or more latching features that are configured to be received into engagement with and then retained by a connector of a subjacent structure (e.g., another wiper plug 100 or a float collar), so as to prevent displacement of the wiper plug 100 from the subjacent structure.

Figure 3:
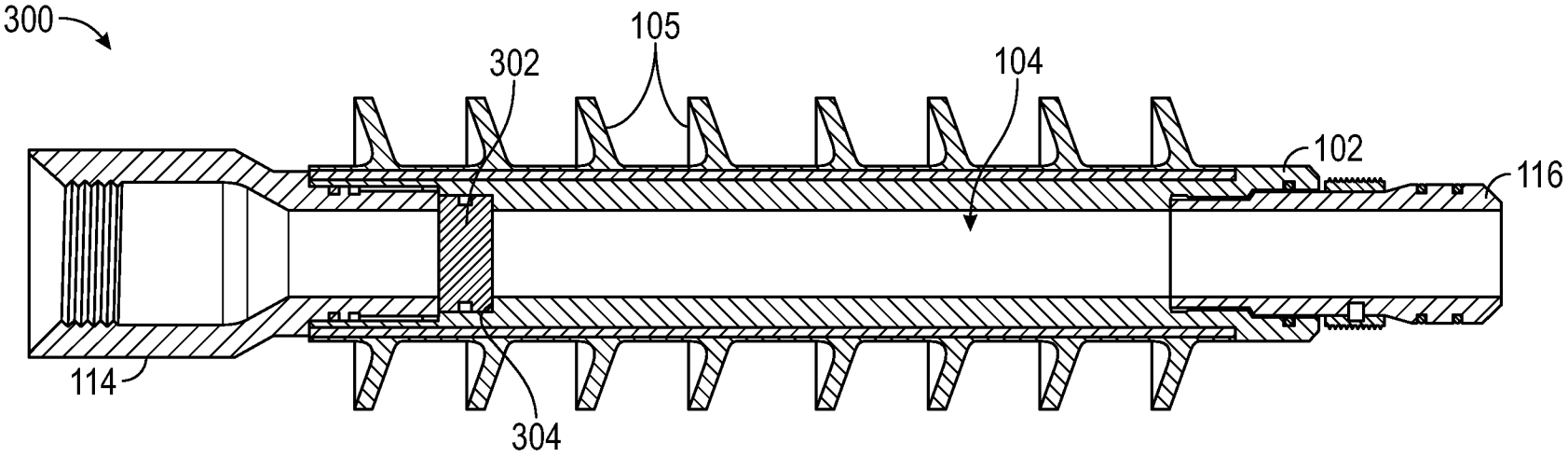
FIG. 3 illustrates a side, cross-sectional view of another wiper plug, according to an embodiment.

FIG. 3 illustrates a cross-sectional view of another wiper plug 300, according to an embodiment. Certain aspects of the wiper plug 300 may be the same in structure and function as the wiper plug 100, and like elements are generally given like numbering herein and a duplicative description thereof may be omitted. The wiper plug 300 may include a valve element 302. The valve element 302 may be or include a solid disk or plug, which may be sealed in place in the bore 104. In a specific embodiment, the valve element 302 may be entrained between the upper connector 114 and a shoulder 304 of the main body 102. The valve element 302 may be made at least partially from a dissolvable material, i.e., a material intended to disintegrate in the presence of a specific wellbore fluid for a predetermined amount of time. For example, the dissolvable material may be a magnesium alloy, a thermoplastic, a plastic-encased animal lard, or the like.

The valve element 302 may be provided, e.g., in lieu of the rupture disk 112, but in other embodiments, a rupture disk 112 could be included along with the valve element 302. Similarly, the valve element 302 may be provided in lieu of the valve element 106, as the valve element 302 may perform the function of blocking fluid flow in at least the uphole direction, as it may, prior to dissolution, prevent fluid flow in both directions through the bore 104. After the predetermined amount of time in the wellbore fluid, the valve element 302 may dissolve and then permit bidirectional fluid flow in the bore 104; however, the predetermined amount of time may be configured to elapse after the cement has at least partially set in the annulus, such that u-tubing is no longer a concern.

Figure 4:
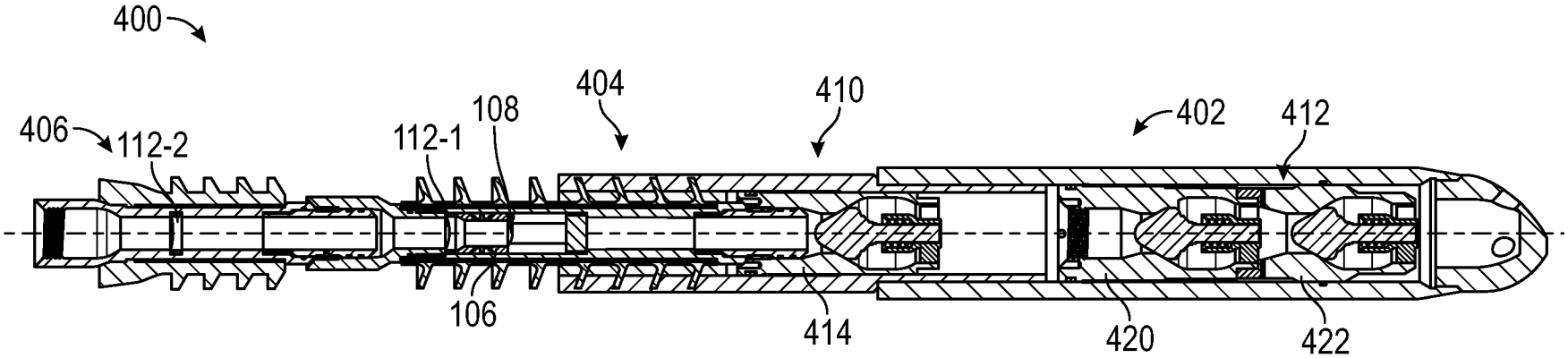
FIGS. 4, 5, and 6 illustrate side, cross-sectional views of a downhole assembly, which includes the wiper plug of FIG. 1, in different configurations during deployment, according to an embodiment.

FIG. 4 illustrates a side, cross-sectional view of a downhole assembly 400, according to an embodiment. In this view, the assembly 400 includes a float tool 402, a first or "bottom" plug 404, and a second or "top" plug 406. In particular, FIG. 4 shows the float tool 402, bottom wiper plug 404, and top wiper plug 406 after each has been separately deployed, such that the bottom wiper plug 404 has landed on the float tool 402, and the top wiper plug 406 has landed on the bottom wiper plug 404. Accordingly, the top wiper plug 406 is superposed with respect to the bottom wiper plug 404, such that the second wiper plug 404 is positioned axially between the top wiper plug 406 and the float tool 402.

In an embodiment, the bottom wiper plug 404 includes the valve element 106 (e.g., including the flapper 108), and thus may be an implementation of the wiper plug 100 discussed above. In other embodiments, the top wiper plug 406 may be the wiper plug 100, or both may be implementations of the wiper plug 100, such that either or both have valve elements 106. Further, in some embodiments, either or both of the bottom and top wiper plugs 404, 406 may include the valve element 302 and may thus be implementations of the wiper plug 300. In still other embodiments, a single plug or three or more plugs, any one or more of which may include the valve element 106 and/or the valve element 302, may be utilized.

Further, the wiper plugs 404, 406 may each include a rupture disk 112-1, 112-2 (e.g., implementations of the rupture disk 112). The rupture disks 112-1, 112-2 may be configured to permit the wiper plugs 404, 406 to be pumped down through the casing string as a solid body, thereby pressing any cement downward through the casing string. Although both rupture disks 112-1, 112-2 are illustrated as intact, in some embodiments, the rupture disk 112-1 of the bottom wiper plug 404 may rupture prior to deployment of the top wiper plug 406, so as to permit fluid communication through the bottom wiper plug 404 and thereby permit the top wiper plug 406 to move downhole and land on the bottom wiper plug 404.

In the illustrated embodiment, the float tool 402 includes a float collar 410 and a float shoe 412. The float collar 410 may be received in or connected to a casing string, which extends past the wiper plugs 404, 406 to the surface (i.e., the wiper plugs 404, 406 are deployed through the casing string and pumped down into their illustrated positions). The float collar 410 generally includes a one-way valve 414, e.g., a plunger valve, as shown. The one-way valve 414 may permit fluid flow in the downhole direction through the float collar 410, but prevent fluid flow in the uphole direction, when functioning properly (e.g., not leaking).

The float shoe 412 may be connected to the float collar 410 and may form the distal end of the casing string. The float shoe 412 may include one or more one-way valves (two shown: 420, 422), which may be, for example, plunger valves. The one-way valves 420, 422 may be configured to permit downhole fluid flow and prevent uphole fluid flow through the float shoe 412, when functioning properly (e.g., not leaking).

Because cement slurry may be abrasive or otherwise tend to erode the material making up the valves 414, 420, 422, wear on the one-way valves 414, 420, 422 may be present. In some cases, this wear can permit cement slurry, prior to setting, to leak back from the annulus into the float shoe 412, the float collar 410, and/or the casing string. To avoid this, one or more of the wiper plugs 404, 406 is provided with the valve element 106, as noted above. Since these wiper plugs 404, 406 may follow the cement, the cement may generally not flow through the valve element 106 provided therein, and thus the valve element 106 may not experience the same abrasive interaction with the cement slurry or be prone to the same type of erosion as the valves 414, 420, 422. Accordingly, the valve element 106 may be more likely to remain fully sealed and intact and thereby prevent leakage of cement back into the casing.

The wiper plug 300 including the dissolvable valve element 302 may operate similarly, and may be readily used in the assembly 400. For example, prior to dissolving, the solid plug of the valve element 302 serves as a barrier to backwards flow of the cement. The predetermined amount of time that the dissolvable valve element 302 takes to dissolve may be selected so that it is sufficient for the cement to at least partially set, thereby ending the potential for u-tubing, as the cement is less flowable. As such, the dissolvable valve element 302 does not erode from flow of cement therepast, but rather assists in displacing the cement out of the float shoe 412 until the valve element 302 dissolves, upon which it permits fluid flow (e.g., in a downhole direction) therethrough.

Figure 5:
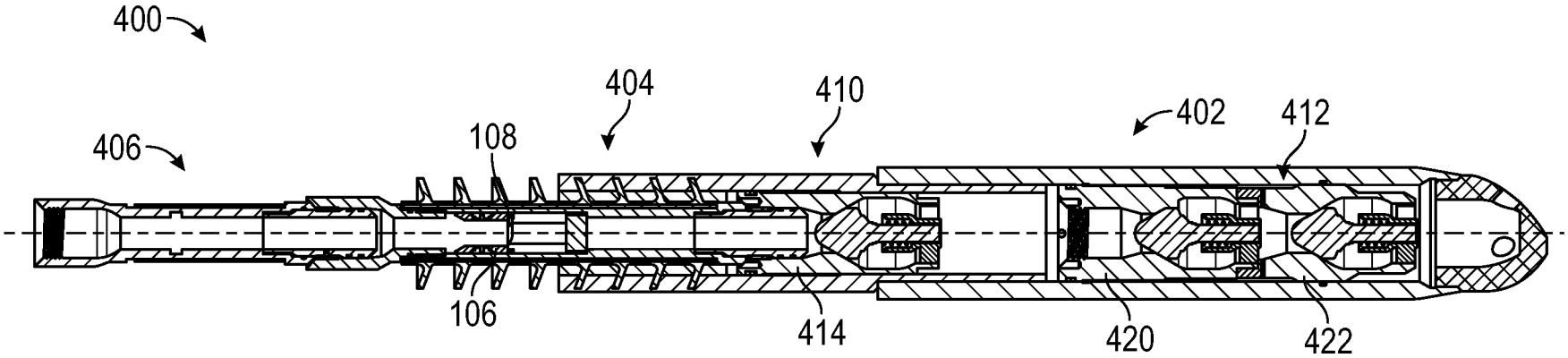
Figure 6:
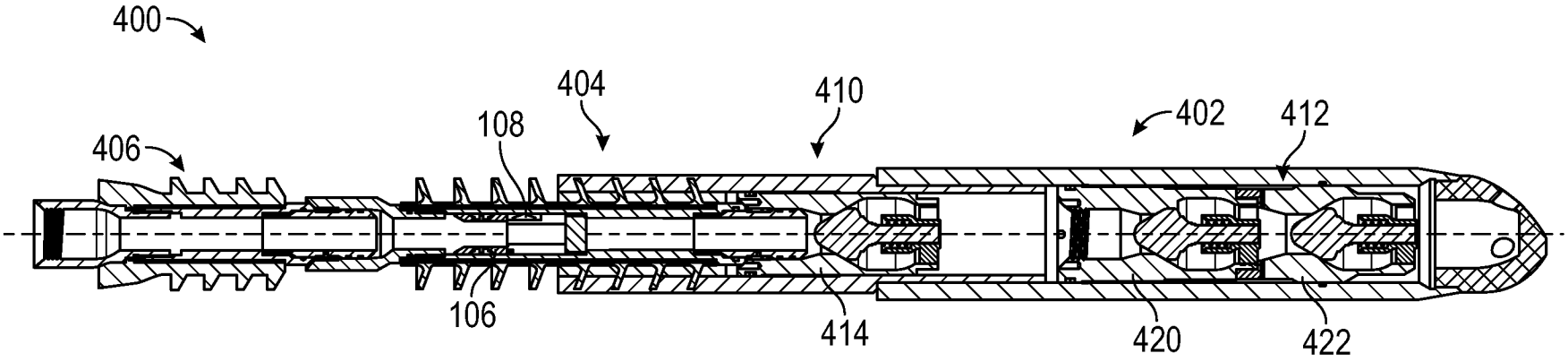

Returning to the illustrated examples, FIG. 5 shows the assembly 400 with both of the rupture disks 112-1, 112-2 from FIG. 4 having been ruptured and removed. For example, the rupture disk 112-1 may be ruptured after deploying the bottom wiper plug 404 down to the float collar 410, and before deploying the top wiper plug 406. Then the rupture disk 112-2 of the top wiper plug 406 is ruptured after deploying the top wiper plug 406 down into engagement with the bottom wiper plug 404. The flapper 108, however, is in a closed position, which blocks fluid flow in the uphole direction (to the left), at least. FIG. 6 shows the flapper 108 in the open position, after the rupture disks 112-1, 112-2 are ruptured, permitting downhole (to the right) directed fluid communication, e.g., to permit pump-down of wireline tools.

Figure 7:
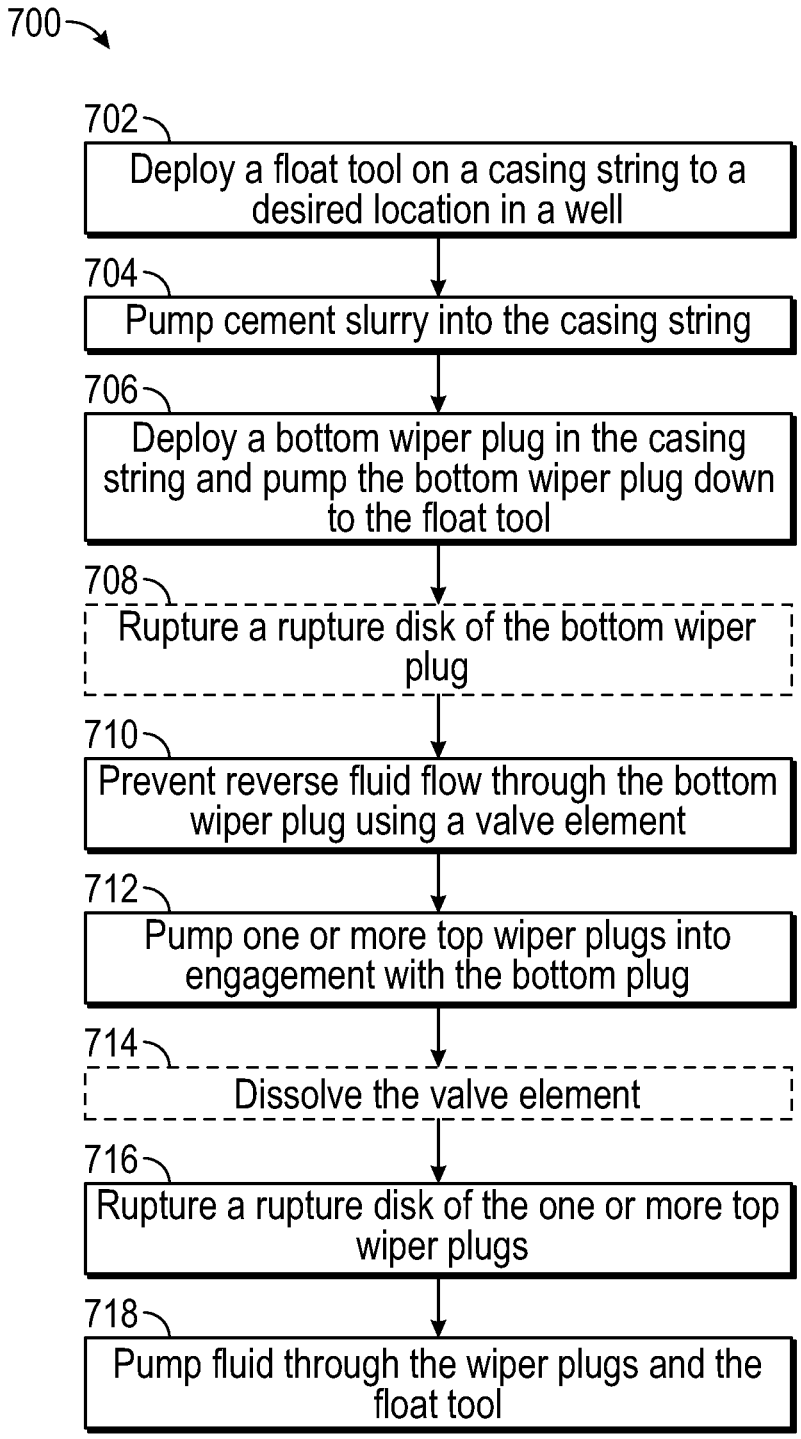
FIG. 7 illustrates a flowchart of a method for cementing a well, according to an embodiment.

FIG. 7 illustrates a flowchart of a method 700 for cementing a wellbore, according to an embodiment. The method 700 may be executed by operation of an embodiment of the downhole assembly 400 and one or more of the wiper plugs 100, 300 discussed above, and thus will be described in herein by reference thereto. However, it will be appreciated that some embodiments of the method 700 may be executed using different structures. Further, the ordering of the various aspects of the method 700 provided herein is merely an example, as the steps of the method 700 may be performed in a different sequence, combined, separated, and/or performed in parallel.

In the illustrated embodiment, the method 700 may include deploying a float tool 402 on a casing string to a desired location in the well, as at 702. The method 700 may then include pumping cement slurry into the casing string, as at 704. Next, a bottom wiper plug 404 may be deployed into the casing, as at 706, and pumped down to the float tool 402, thereby displacing the cement slurry from the casing string, through the float tool 402, and into the annulus between the casing string and the wellbore.

In some embodiments, a rupture disk 112-1 of the bottom wiper plug 404 may be ruptured by increasing a pressure in the casing string to a predetermined level, as at 708. The predetermined pressure may be between about 1000 psi and 1500 psi, e.g., about 1250 psi. This may permit fluid communication in at least a downhole direction through the bottom wiper plug 404. In some embodiments, the method 700 may include preventing reverse fluid flow in an uphole direction through the bottom wiper plug 404 using a valve element 106 provided in the bottom wiper plug 404, as at 710.

The method 700 may then include pumping (or otherwise deploying) one or more top wiper plugs 406 through the casing string into engagement with the bottom wiper plug 404, as at 712 such that a fluid communication path is established directly between the top wiper plug 406 and the bore 104 of the bottom wiper plug 404. In some embodiments, the method 700 may include dissolving a dissolvable valve element 302 of the top wiper plug 406, e.g., after pumping down the one or more top wiper plugs 406, as at 714.

In some embodiments, the top wiper plug 406 (or at least one of the top wiper plugs 406) may include a rupture disk 112-2. At 716, the method 700 may thus include rupturing the rupture disk 112-2 of the top wiper plug 406 by increasing the pressure in the casing string to a predetermined level (e.g., about 1000 psi to about 1500 psi, e.g., about 1250 psi), and thereby establish fluid communication through the top wiper plug 406, bottom wiper plug 404, and float tool 402. The method 700 may then include pumping fluid through the top wiper plug 406, bottom wiper plug 404, and float tool 402, e.g., to support deployment of wireline tools into the casing string, as at 718.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole assembly, comprising:

a float tool configured to be connected to a casing string and including one or more one-way valves configured to permit fluid flow in a downhole direction and to prevent fluid flow in an uphole direction; and a first wiper plug configured to be deployed into a well via the casing string and engage the float tool, wherein the first wiper plug comprises:

a valve element that is configured to prevent fluid flow through the first wiper plug at least in the uphole direction; and a rupture disk configured to break at a predetermined pressure, wherein the rupture disk prevents fluid flow through the first wiper plug in both the uphole and downhole directions prior to rupturing.

2. The downhole assembly of claim 1, wherein the one or more one-way valves of the float tool are configured to receive a cement slurry therethrough, and wherein the valve element of the first wiper plug is configured not to receive the cement slurry therethrough.

3. The downhole assembly of claim 1, wherein the first wiper plug defines a bore axially therethrough, and wherein the valve element is positioned within the bore and is not separately deployable into the well.

4. The downhole assembly of claim 3, wherein the valve element comprises a flapper valve positioned in the bore of the first wiper plug.

5. The downhole assembly of claim 4, wherein the flapper valve is biased toward a closed position in which the flapper valve blocks fluid flow, and wherein fluid flow in the downhole direction forces the flapper valve out of the closed position and into an open position.

6. The downhole assembly of claim 1, further comprising a second wiper plug that is configured to be deployed into the well and to engage the first wiper plug.

7. The downhole assembly of claim 6, wherein the second wiper plug is superposed with respect to the first wiper plug, such that the first wiper plug is positioned axially between the second wiper plug and the float tool.

8. The downhole assembly of claim 6, wherein the second wiper plug comprises a valve element configured to prevent fluid flow through the second wiper plug at least in the uphole direction.

9. The downhole assembly of claim 1, wherein the valve element comprises a dissolvable disk.

10. The downhole assembly of claim 1, wherein the float tool comprises a float shoe and a float collar that is connected to the float shoe, the first wiper plug being receivable at least partially in the float collar and configured to latch therein.

11. The downhole assembly of claim 1, wherein the valve element comprises a flapper valve including a base and a flapper that is pivotally secured to the base, and wherein the flapper is biased toward a closed position in which the flapper extends across the base and prevents fluid flow through the base at least in the uphole direction.

12. The downhole assembly of claim 11, wherein the valve element further comprises:

a spacer that is coupled to and extends from the base; and an end ring that is coupled to the spacer, wherein the end ring is positioned in engagement with a shoulder in the first wiper plug.

13. A method for cementing a well, comprising:

deploying a float tool comprising one or more one-way valves into a well as part of a casing string;

pumping cement into the casing string in the well;

deploying a first wiper plug through the casing string down to the float tool so as to displace at least some of the cement from the casing string into an annulus between the casing string and the well;

preventing the cement from flowing in an uphole direction through the first wiper plug using a valve element positioned in the first wiper plug;

pumping fluid through the first wiper plug in a downhole direction after deploying the first wiper plug down to the float tool;

deploying a second wiper plug through the casing string until the second wiper plug engages the first wiper plug; and rupturing a rupture disk in the second wiper plug by increasing a pressure in the casing string.

14. The method of claim 13, wherein the valve element comprises a flapper valve configured to permit fluid flow in the downhole direction through the first wiper plug but prevent fluid flow in the uphole direction through the first wiper plug.

15. The method of claim 13, further comprising rupturing a rupture disk in the first wiper plug by increasing a pressure in the casing string.

16. The method of claim 13, further comprising dissolving the valve element prior to pumping fluid through the first wiper plug in the downhole direction.

17. A downhole assembly, comprising:

a float shoe comprising two or more one-way valves;

a float collar coupled to the float shoe and comprising one or more one-way valves;

a first wiper plug that is configured to land on the float collar, the first wiper plug including a valve element configured to prevent fluid flow through the first wiper plug at least in an uphole direction; and a second wiper plug that is configured to land on the first wiper plug, the second wiper plug including a rupture disk configured to block fluid flow through the second wiper plug, wherein, upon rupturing the rupture disk, the second wiper plug permits fluid flow therethrough at least in a downhole direction.

18. The downhole assembly of claim 17, wherein the valve element comprises a flapper that has an open position and a closed position, wherein, in the open position, the flapper permits fluid flow in the downhole direction through the valve element, and in the closed position, the flapper prevents fluid flow in the uphole direction through the valve element, and wherein the first wiper plug further comprises a rupture disk therein that is configured to rupture at a predetermined pressure.

19. The downhole assembly of claim 17, wherein the valve element comprises a dissolvable disk configured to dissolve after a predetermined amount of time in a well.

* * * * *